United States Patent [19]

Hubbard

[11] 4,345,708

[45] Aug. 24, 1982

[54] DOCUMENT FEED MECHANISM

[75] Inventor: Leo J. Hubbard, Somerset, Mass.

[73] Assignee: P.H.D. of Puerto Rico, Inc., Fajardo, P.R.

[21] Appl. No.: 153,394

[22] Filed: May 27, 1980

[51] Int. Cl.[3] ..... B65H 17/38

[52] U.S. Cl. ..... 226/74; 192/95; 226/4; 226/6; 226/75; 226/108; 226/188

[58] Field of Search ..... 226/74, 75, 108, 111, 226/113, 188, 4, 6; 192/89 R, 95, 66

[56] References Cited

U.S. PATENT DOCUMENTS 2,457,367 12/1948 Hale ..... 192/95 X

FOREIGN PATENT DOCUMENTS 757302 9/1956 United Kingdom ..... 226/4

*Primary Examiner*—Stanley N. Gilreath

*Attorney, Agent, or Firm*—Martin LuKacher

[57] ABSTRACT

A bi-directional feed mechanism for webs, especially for plotting and generating special characters, forms and shapes on the webs, uses twin pairs of tractors which feed a web around a loop which may contain a platen roller. Each pair of tractors is mounted on and driven by its own drive shaft. The drive shaft of one of the tractor pairs is driven from the drive shaft of the other tractor pair through a manually releasable clutch which may be mounted on, and movable along the axis of, the driven shaft. The tension in the loop may be adjusted by releasing the clutch so that one of the tractor pairs may be driven while the other is stationary. Webs and other documents which may vary in length and require tension adjustments may readily be fed by means of the mechanism. The arrangement of the tractors also enables the webs to be easily loaded from the top.

10 Claims, 7 Drawing Figures

DOCUMENT FEED MECHANISM

The present invention relates to web feed mechanisms and particularly to an improved mechanism for feeding webs, such as computer forms and other documents which enables the tension in the web to be adjusted.

The invention is especially suitable for use as a bi-directional document feeder for plotters, printers, tele-typewriters, and other computer peripheral equipment in which edge perforated documents are used. The invention provides for the precise feeding and registration over the same locations on the document to enable printing of forms, shapes, and special characters, and also insertion of characters and words, in documents previously printed, by reverse feeding, back spacing and the like movement of the document. The invention is also applicable wherever the precision handling of documents is desired.

Variations in the tension of a web as it is driven around a loop affects the accuracy and precision of the feed. Such tension variations may cause misalignment of a printer head with the lines of a form printed on the document. Uneven spacing of lines and other graphic errors may also result from printing on a web having improper tension therein.

Computer forms tractors provide precision handling of webs and have become accepted for use in document feed mechanisms for printers, tele-typewriters and other computer peripheral equipment. Although tractor drives have been available for some time (see U.S. Pat. No. 2,248,188 of July 8, 1941; 2,286,084 of June 9, 1942; 2,302,704 of Nov. 24, 1942; 2,313,888 of Mar. 16, 1943; 3,006,520 of Oct. 31, 1961; and 3,407,981 of Oct. 29, 1968) suitable means for adjusting the tension in a web, and particularly in a loop of the web which is entrained around a platen roller, has not been available. Neither has top loading of webs in bi-directional feeding mechanisms been convenient.

It has been proposed to use web guides which engage the web to take-up and tension it (see the above referenced U.S. Pat. No. 2,302,704). The guide places a drag on the web which may be variable and which may affect the precision feeding thereof. Additional torque and power which is necessary to overcome the drag due to the guide may not be available and may adversely affect the motor, bearings and other parts of the drive mechanism. It has also been proposed to mount the document feed tractors on shafts which may be moved along the web feed path. The complexity of the mechanism for displacing the shafts and the imprecision and inaccuracy in the drive which movable shafts entail, make this approach unsatisfactory for most applications. Loading in mechanisms which feed bi-directionally has required pivotally mounted tractors which must be carefully threaded to insert the web. The document feeds path, for example "S" or of serpentine shape, makes top loading difficult.

An object of the invention is to provide an improved bi-directional web feed mechanism, and particularly such a mechanism using tractors, which enables webs to be loaded easily and from the top of the equipment (e.g. the printer or plotter) with which the feed mechanism is used.

Another object of the invention is to provide an improved feed mechanism which can be used on existing printers and plotters and which obtains power for feeding the documents from the motor or other driving mechanism thereof, and which does not impose any significant increase in load upon such motor or drive mechanism.

Still another object of the invention is to provide an improved feed mechanism for bi-directional drive of a perforated web which has substantially zero backlash between a pin feed which engages the edges of the perforations upon reversal of feeding direction, thus eliminating substantially misregistration upon reversal of direction of feeding and enabling overprinting, insertion of characters or words, and/or the generation of special character forms and shapes which require reversal of feeding.

Still another object of the invention is to provide an improved feed mechanism having web tension control, useful in accommodating for variations in form length, due, for example, to environmental conditions, such as heat or moisture, as well as to variation tolerances in the length of the form or document.

A still further object of the invention is to provide an improved feed mechanism for webs which execute a loop around a platen of a printer wherein the tension of the web in the loop may be adjusted so as to provide for precision handling of the web.

A still further object of the invention is to provide an improved document feed mechanism incorporating tractors which provides convenient adjustment of the tension in the document.

A still further object of the invention is to provide an improved mechanism which enables accurate feeding of a web around a loop by accommodating changes in loop length such as due to humidity or web thickness, as where the web is a multi-sheet document such as a multi-part form.

A still further object of the present invention is to provide an improved web feed mechanism having tension adjustment means which does not require tensioning guides, bars or other means which place a drag on the web during normal feeding operations.

A still further object of the invention is to provide an improved web feeding mechanism which is capable of adjusting web tension without complex mechanisms, such as for drive shaft displacement, which interfere with the precision handling of the web.

Briefly described, a web drive mechanism embodying the invention feeds the web around a loop, which may be entrained around a platen roller, and incorporates a tensioning mechanism which makes use of web feeding means, preferably twin pairs of tractors which can feed the web bi-directionally around the loop. One of the tractor pairs is operative to feed the web with respect to the other so as to change the tension in the loop. Particularly, a drive train between the tractor pairs includes a clutch mechanism which may be manually released such that one of the tractor pairs remains stationary while the other may be actuated to feed the web by precision amounts into or out of the loop thereby adjusting the tension therein.

The foregoing and other objects, features and advantages of the invention as well as a presently preferred embodiment thereof will become more apparent from a reading of the following description in connection with the accompanying drawings in which.

Figure 2:
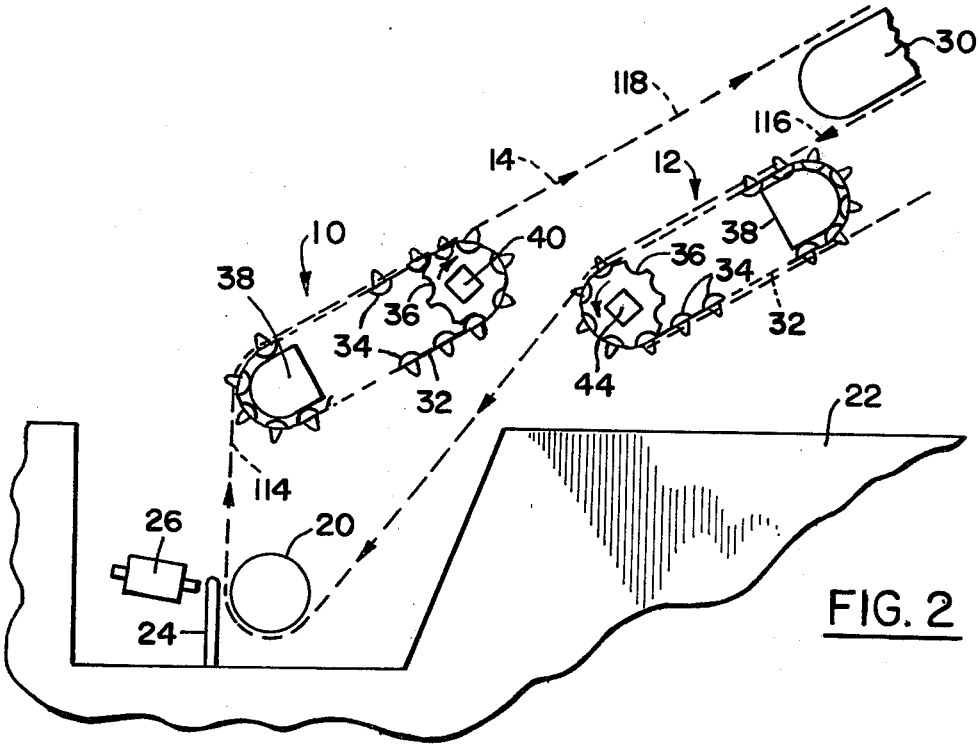
FIG. 2 is a simplified sectional view taken along the line 2—2 in FIG. 1 which illustrates, diagrammatically, the web feed path.

Referring more particularly to the drawings, a front pair of tractors 10 and a back pair of tractors 12 constitute twin tractors which are used to drive a continuous web of paper along the path 14 shown by the dashed line in FIG. 2. The web is driven vertically in the upward direction as shown by the arrows on the dashed path line 14. By reversing the drive, the web may be driven in the reverse direction for back-spacing, for example. The twin tractor pairs 10 and 12, in this embodiment are part of a document feed mechanism 16 which is mounted on the shaft 18 of a platen roller 20 of a printer 22. The printer may be of the type having a daisy type wheel 24 and hammer 26 which are translated in a direction axially of the platen roller 20 so as to print lines of characters on the document.

The document itself may be a computer form which is a continuous web having edge perforations engaged by drive pins 28 extending from belts 32 of the twin tractor pairs 10 and 12. The documents may be fan folded and may be unfolded by guides, such as the guide 30 diagramatically shown in FIG. 2. The documents may be fed into and out of the tractors 10 and 12 by rollers 43. These rollers remove any drag on the documents and consequent load on the motor, bearings and other drive mechanism in the printer 22 which might be caused by a turn in the feed path, as around the edges of the side plates 45 of the tractor frames 47 (see FIGS. 1, 6 and7).

Figure 6:
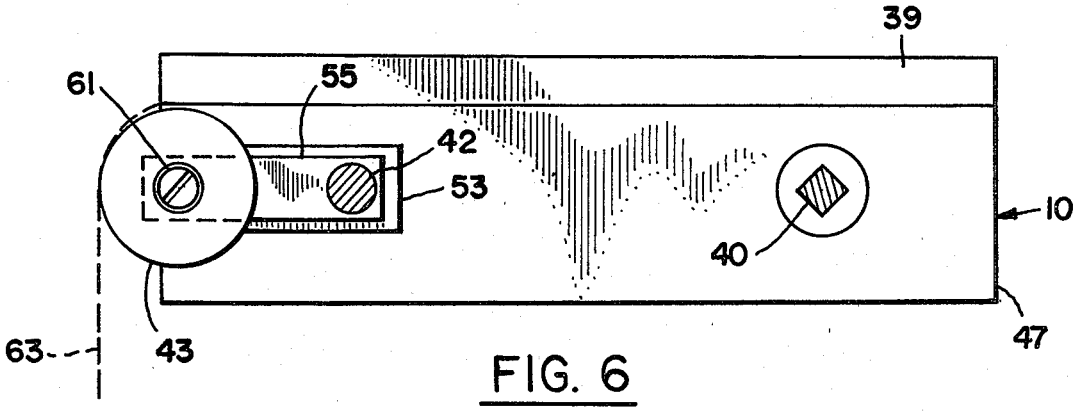
FIG. 6 is a side view of one of the tractors showing a guide roller for reducing drag on the web and loading of the drive motors and mechanisms of the printer, the view being taken along the line 6—6 in FIG. 1 in the direction of arrows.
Figure 7:
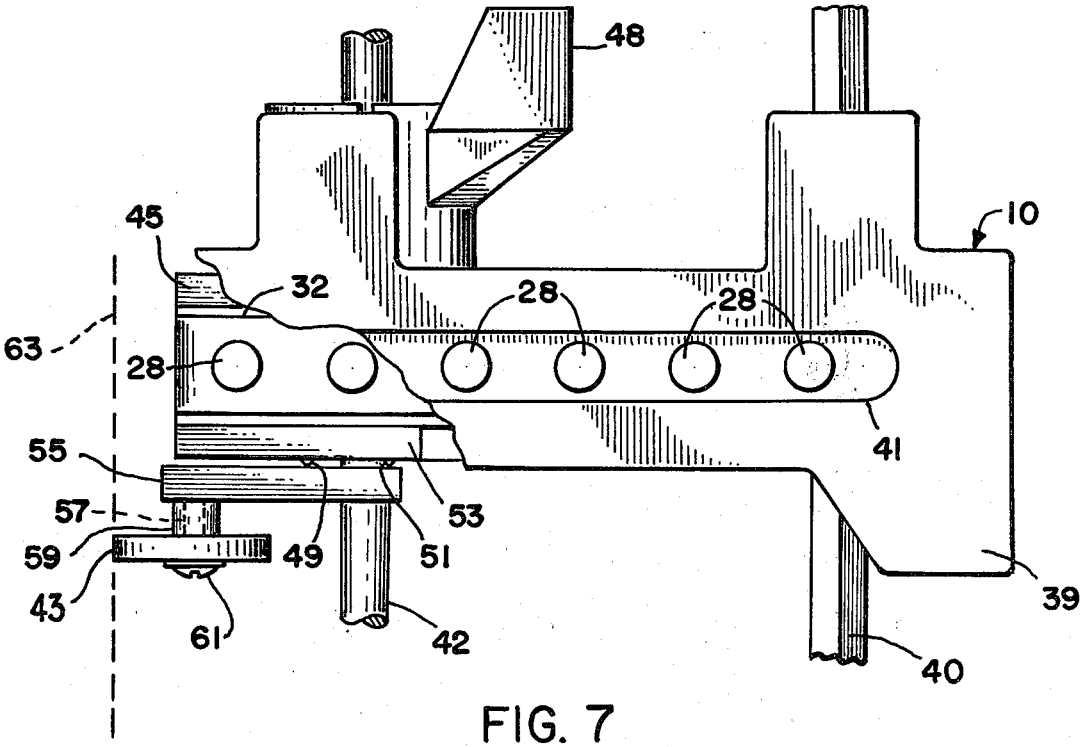
FIG. 7 is a rear view of the tractor shown in FIG. 6 with the cover or lid thereof partially broken away to show the guide roller assembly.

These rollers 43 are parts of assemblies which may be attached, as by ultrasonically welding at 49 and 51, to the foot portions 53 of clamp mechanisms 48 of the tractors. The assemblies contain beams 55 which are welded to the foot portions 53. The rollers are journalled on shafts 57 surrounded by spacers 59. The rollers are retained on the shafts 57 by screws 61. Since they are free to roll, the documents 63, shown by the dash lines in FIGS. 6 and 7, are brought essentially frictionessly into a path coplanar with the upper reaches of belts 32. Because of the rollers 43 in the back tractors 12, the documents may be pulled up from the fan folded supply thereof directly into the feed mechanism, instead of via the guide 30, if desired.

The belts 32 also have hemi-cylindrical drive rollers 34 which are driven by sprockets 36 in the tractors. The rollers travel around the sprockets 36 and around guides 38. Each tractor has a cover or lid 39 with a slot 41 through which the pins 28 extend (see FIGS. 1 and 7). For further information as to the design of the tractors 10 and 12 reference may be had to U.S. Pat. No. 4,129,239 issued in the name of Leo J. Hubbard on Dec. 12, 1978.

The front tractors 10 are mounted on a square drive shaft 40 which extends through the sprockets 36 therein (see FIG. 2) and on a guide shaft 42. The back tractors 12 are similarly mounted on another square drive shaft 44 and a guide shaft 46. The tractors are movable axially on these shafts 40 through 46 so that their lateral position may accurately be adjusted with respect to the edge perforations on the document to be fed. After adjustments, the tractors are locked in place by the clamp mechanisms 48 operated by levers. These clamp mechanisms are preferably collet clamps of the type described in connection with FIGS. 5 to 9 of the above referenced Hubbard U.S. Pat. No. 4,129,239.

Figure 4:
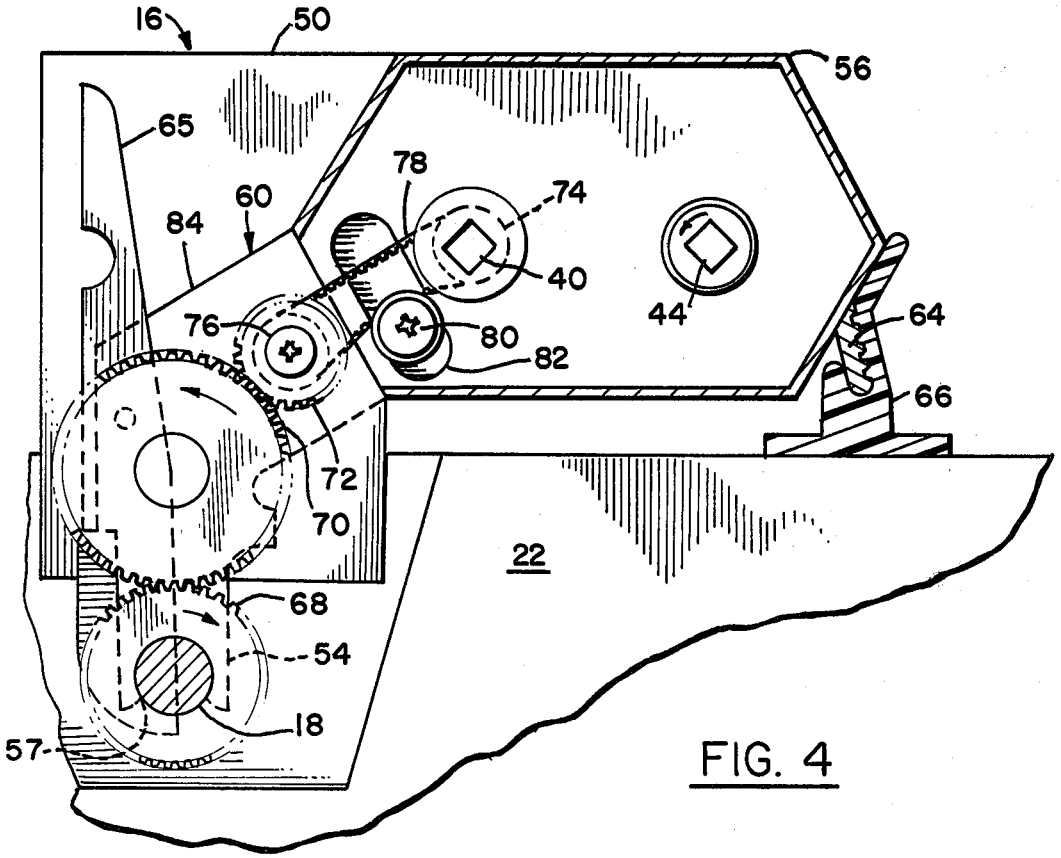
FIG. 4 is a sectional end view of the mechanism taken along the line 4—4 in FIG. 3.

The guide shafts 42 and 46 are fixedly mounted in the side plates 50 and 52 of a frame for the mechanism 16. Forks extend downwardly from the frame and fit over platen roller extensions 18. One of these forks 54 on the plate 50 is illustrated in FIG. 4. Boxes 56 and 58 on the plates 50 and 52, respectively, enclose part of a drive train 60 which is mounted on the side plate 50 and another drive train 62 which is mounted on the other side plate 52. A flange 64, which extends from the box 56, is received in a locating bracket 66 on the top of the printer 22. The flange 64 and the fork 54 support the mechanism 16 in place on the printer 22. The flange 64 and the bracket 66 may have interlocking teeth. The bracket 66 is suitably made of flexible material (e.g., plastic) and is bent back to release the flange to enable removal of the dual tractor drive assembly.

Levers 65, pivotally mounted on the side plates 50 and 52, and have semicircular slots 57, are pivoted to the position shown in FIG. 4 over the forks 54 to lock the mechanism 16 in place on the printer 22. A flanged bracket 84 also provides a cover for the drive train 60 to prevent foreign objects from dropping into the drive train when the mechanism 16 is in place on the printer 22 and also to protect against injury to the operator.

The feed mechanism, in this embodiment of the invention is powered by the printer 22. A separate motor, such as a stepping or servo motor, may be used to power the mechanism. The drive train 60 is driven with the platen roller 20 via a drive gear 68 thereon (see FIG. 40. The drive gear 68 is meshed with another gear 70 when the mechanism 16 is mounted on the printer 22. A separate motor for example could be used to drive the gear 70 directly. A gear 72 and toothed pulley 76 and the drive gear 70 are rotatably mounted on the side plate 50. The gear 72 is meshed with the gear 70. Another toothed pulley 74 having a square hole in which the square drive shaft 40 of the front tractor pair is received, rotates and drives the shaft 40. These pulleys 74 and 76 are coupled to each other by a timing belt 78. The slack in the belt is taken up by a post 80 which is movable along a slot 82 in the plate 50 and may be attached to the plate in the slot 82 at a desired location.

Figure 1:
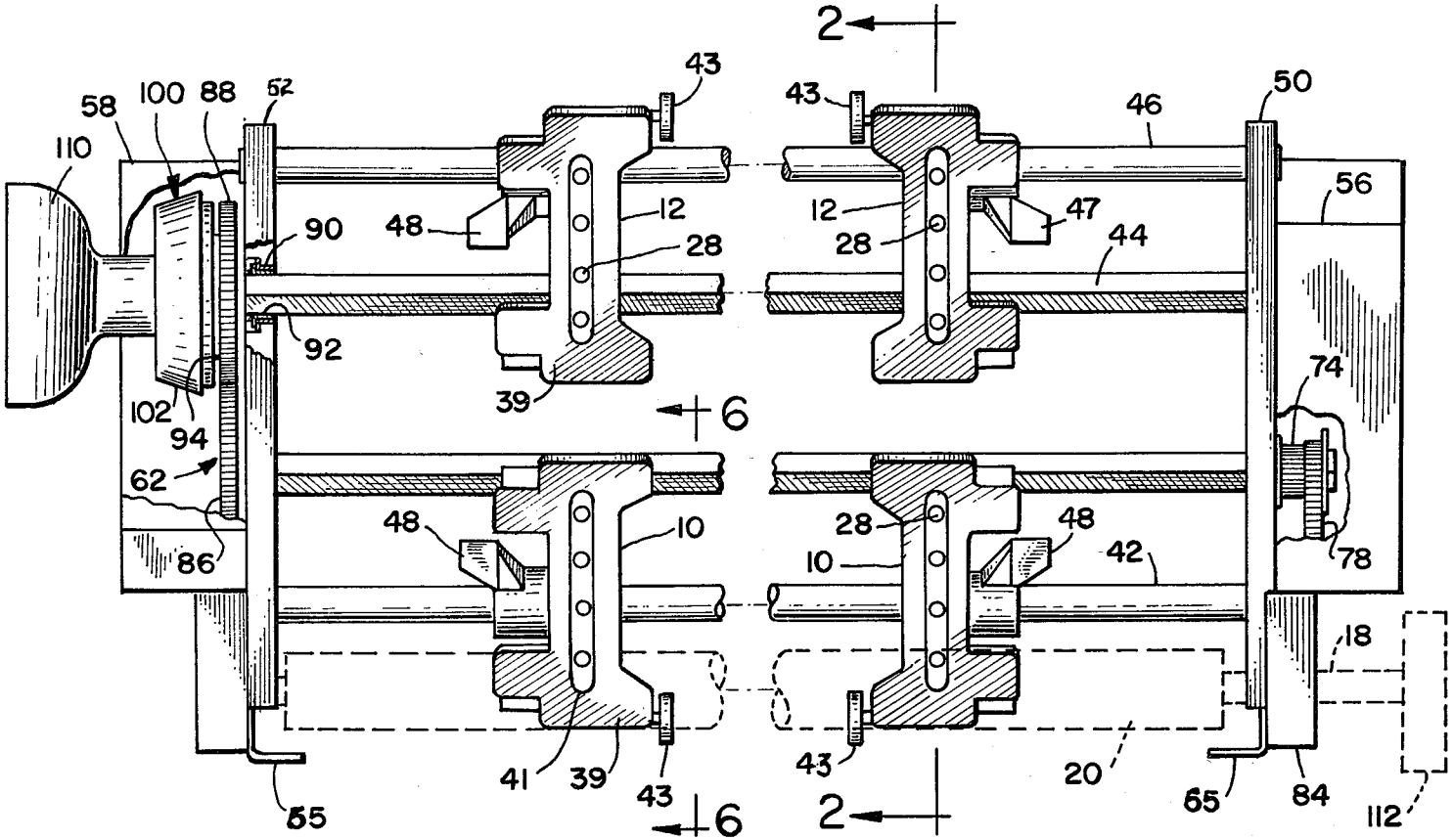
FIG. 1 is a plan view of a twin tractor document feed mechanism which embodies the invention disposed in operating relationship with the platen of a printer.
Figure 5:
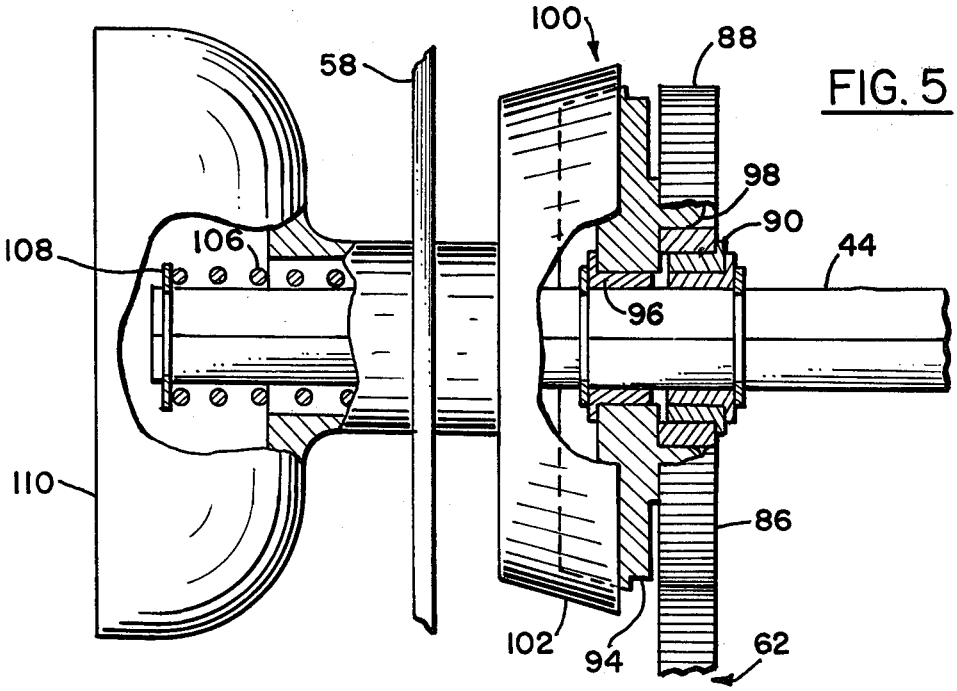
FIG. 5 is an enlarged fragmentary plan view showing the clutch assembly of the mechanism illustrated in FIGS. 1 through 4.

The other drive train 62 is best illustrated in FIGS. 1 and 5. The drive shaft 40 of the front tractor pair 10 is rotatably mounted with and drives a drive wheel 86. Another drive gear 88, which is rotatable in bearings 90 on and coaxial with the drive shaft 44 for the back tractors 12, is meshed with the drive gear 86. The drive shaft 44 is mounted in bearings 92 in the side plate 52 (see FIG. 1). A conical clutch plate 94 is also mounted coaxially with the shaft 44 and is rotatable in a bushing 96 on the shaft 44. The clutch plate 94 is attached to the drive gear 88, as by ears 98 or weldments, and is rotatable with the drive gear 88. A clutch 100 is provided by the clutch plate 94 and another conical clutch plate 102.

The interior conical surface of the clutch plate 102 and the exterior conical surface of the clutch plate 94 are biased into engagement with each other by a spring 106 which bears against the clutch plate 100 and a snap-on washer 108 at the end of the shaft 44 (see FIG. 5). The clutch plate 102 is connected, as by being part of a unitary assembly, with a knob 110. The clutch plate 102 has a square hole which receives the shaft 44 so that the clutch plate 102 and the knob 110 rotate with the shaft 44. To disengage the clutch, the knob 110 is pulled to the left along the axis of the drive shaft 44. When the knob 110 is released, the spring 106 biases the clutch plate 102 against the other clutch plate 94 so that the clutch is in engagement.

Figure 3:
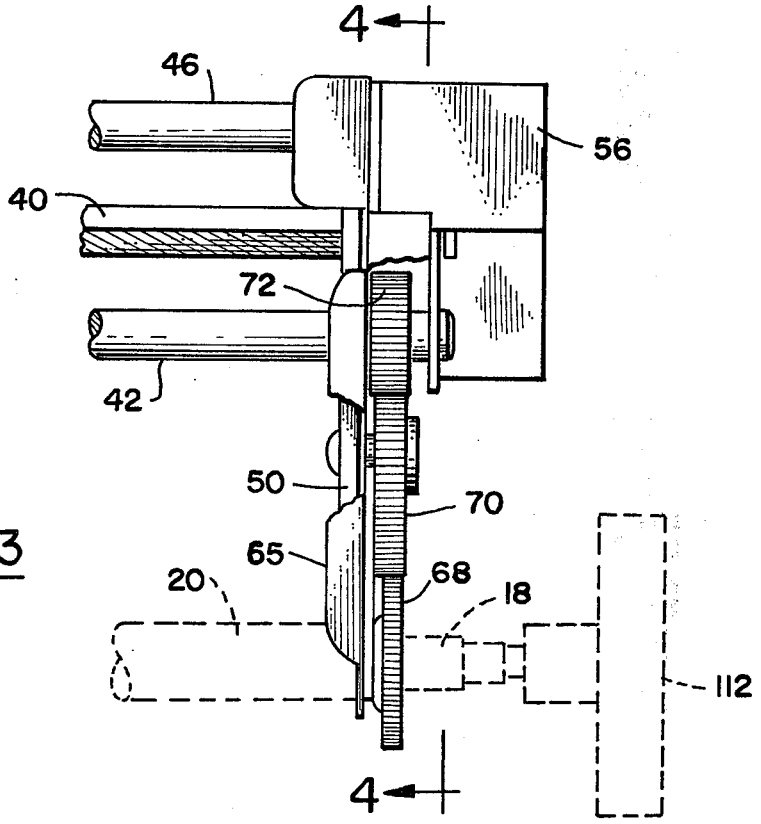
FIG. 3 is a fragmentary view in elevation of the portion of the mechanism illustrated on the right side of FIG. 1.

In operation, the platen roller 20 is indexed or rotated by the drive means in the printer or it may be rotated manually by a knob 112 which is connected to the extension shaft 18 thereof (see FIGS. 1 and 3). The document is inserted below the guide bar 30 and is fed along the path 14 by the back tractors 12 around a loop 114 which is entrained around the platen roller 26.

The documents are very easy to load from the top of the mechanism. The tractor pairs 10 and 12 are offset from each other along the path 14 (see FIG. 2). The lid 39 of the back tractor pair 12 clears the front pair 10, for top insertion of the documents when loading. The tractors do not have to be pivoted so as to engage the pins with the documents both on the upper and lower reaches of the belts. The path through the tractors is straight (see FIG. 2) and not serpentine as required in conventional tractor feed mechanisms which drive documents bi-directionally.

The loop is terminated at the opposite ends thereof by the front and back tractor pairs 10 and 12. The portions 116 and 118 of the web which pass over and are in driving relationship with the tractor pairs 10 and 12 are parallel to each other such that the web is in parallel planes in these portions 116 and 118. The guide rollers on the back tractors 12 enable the web to be pulled in from below the printer 22 directly into the feed mechanism and yet arrive essentially in the plane of the belt 32.

During normal driving (vertically upward) for successive lines, the web travels in the direction shown by the arrows on the path 14 in FIG. 2. The platen drive gear 68, the drive gears 70 and 72 and the pulleys 74 and 76 rotate in the directions shown by the arrows thereon to drive the front tractors 10 in the direction to positively feed the web out of the loop 114.

The shaft 40 of the front tractors 10 is coupled to the drive train 62 and the clutch 100 to the shaft 44 of the back tractor pair 12. The back tractors then move in the direction opposite to the front tractors and positively feed the web into the loop 114. The web is always driven positively for precision and accurate handling. The drive direction is bi-directional and automatically reverses when the platen rotation reverses. The back tractors 12 then pull and the front tractors 10 push the documents.

In order to adjust the tension in the loop, the knob 110 is pulled out to the left thereby releasing the clutch 100. The back tractor pair 12 is then disengaged from the drive train 62. The back tractors 12 are then stationary. The front tractors 10 may then be driven, in either direction, to feed the web into the loop 114 when additional slack or less tension in the loop 114 is desired, or to feed the web out of the loop 114 and take up the slack or increase the tension in the loop 114. Variations in the length of the web, such as due to humidity or when multi-part forms are being fed, can readily be accomplished in a simple and reliable manner by means of the feed mechanism 16.

When the tension in the web is adjusted in the manner just described, the pins 28 and the edges of the perforation in the document are brought into contact by the movement of the entire drive train. Backlash between the pins and the perforations is essentially eliminated. Then even when the feed direction reverses, for example to back space to a line already printed to insert a character or word or to over-print, registration is exact. The feed mechanism thus, provides precision bi-directional feed suitable for over-printing, insertion of characters and words in existing lines, and/or the generation of special character forms and shapes which require reversal of feeding.

From the foregoing description, it will be apparent that there has been provided an improved feed mechanism for webs, such as computer forms and similar documents, which is readily loaded, has tension adjusting means readily accessible to and easily operated by the user of a printer or other machine through which the document is fed, and provides precise registration even upon back spacing or reversals of feed direction. Variations and modifications of the herein described feed mechanism and other applications therefor will undoubtedly suggest themselves to those skilled in the art. Accordingly, the foregoing description should be taken as illustrative and not in a limiting sense.

I claim:

1. A web feed mechanism which comprises first and second feeding means which are disposed in driving relationship with the web when it is driven and which are spaced from each other to define a length of said web therebetween, driving means coupling said first and second feeding means in driving relationship with each other, said driving means comprising driven means connected in driving relationship with said second feeding means, means coupling said first feeding means to said driven means for driving said first feeding means when said second feeding means is driven, and a clutch in said means coupling said first feeding means to said driven means for decoupling said first feeding means from driving relationship with said driven means so that said second feeding means can move said web with respect to said first feeding means until the tension in said length of said web is adjusted, said clutch having a pair of plates one of which is rotatable with said driven means and the other of which is rotatable with said first feeding means, and manually operable means connected to said other of said plates for separating said plates and holding said first feeding means stationary to prevent movement thereof with respect to said web until said tension in said length of said web is adjusted.

2. The invention as set forth in claim 1 further comprising spring means coupled to said other plate of said clutch for biasing said clutch plates together so as to bring said first feeding means into driving relationship with said driven means through said clutch when said manually operable means is released.

3. The invention as set forth in claim 2 wherein said first and second feeding means respectively are first and second pairs of web feed devices in engagement with said web adjacent to the opposite edges thereof, first and second drive shafts for said first and second feed devices, respectively, on which said first and second pairs of feed devices are respectively mounted, said driving means being coupled to said second drive shaft and said first and second drive shafts being coupled to each other via said clutch.

4. A mechanism for feeding a web along a path having a loop which comprises a first pair of tractors and a second pair of tractors having belts dispose along said path and drive pins on said belts engageable with said web with each of said tractor pairs being disposed at an opposite end of said loop, first and second drive shafts disposed across said path, said first and second shafts being mounted on and in driving relationship with said first and second tractor pairs, respectively, a first drive train coupled to said first drive shaft for rotating said first drive shaft in a direction to drive said first tractor pair to feed said web in opposite directions along said path and around said loop, a clutch having inter-engaging plates rotatable with said second drive shaft when said plates are engaged with each other, a second drive train coupled to said first drive shaft and to one of said clutch plates for rotating said second drive shaft in a direction to drive said second tractor pair to feed said web in opposite directions along said path and around said loop when said clutch is engaged, the other of said clutch plates being rotatable with and axially movable on said second drive shaft, and means for retracting said other clutch plate from said one clutch plate while holding said second shaft from rotating, whereby said second tractor pair maintains said web, at the end of said loop at which said second tractor pair is disposed, fixed when said clutch is disengaged to enable the tension in said loop to be adjusted by driving said first tractor pair.

5. The invention as set forth in claim 4 wherein said loop is entrainable around a platen roller, and means in said first drive train engageable with said platen roller in driving relationship.

6. The invention as set forth in claim 4 wherein said second drive train comprises a drive member coaxial with said second shaft and rotatably mounted on said second shaft, said one of said clutch plates also being coaxial with said second shaft and mounted on said second shaft in driving relationship with said drive member, said other of said clutch plates being coaxial with said second shaft and slidably movable axially thereon, said second shaft and said other clutch plate being rotatably connected to each other, a spring biasing said clutch plates into engagement, a knob connected to said other clutch plate for moving said other clutch plate axially along said shaft against the bias of said spring to disengage said clutch plates while holding said second shaft against rotation to enable adjustment of tension in said loop.

7. The invention as set forth in claim 4 wherein said first tractor pair and said second tractor pair are engageable with said web along planes which are parallel to and spaced from each other to define linear portions of said path each at an opposite end of said loop.

8. The invention as set forth in claim 6 further comprising a frame having parallel plates laterally spaced from each other, said shafts being journaled in said plates at opposite ends of said shafts, said first drive train being rotatably mounted on one of said plates and said second drive train being rotatably mounted on the other of said plates.

9. The invention as set forth in claim 8 further comprising first and second guide shafts connected to said plates and extending laterally therebetween, said drive shafts and said guide shafts being parallel to each other, said first tractor pair being mounted on and axially movable along said first guide and drive shafts to positions at one end of the loop adjacent opposite edges of said web, and said second tractor pair being mounted on and axially movable along said second drive and guide shaft to positions at the opposite end of the loop adjacent opposite edges of said web.

10. The invention as set forth in claim 7 further comprising rollers rotatably mounted on each of said tractors for guiding said web into said linear portions across said tractors.

* * * * *